US005195334A

United States Patent [19]

Lang et al.

[11] Patent Number: 5,195,334

[45] Date of Patent: Mar. 23, 1993

[54] HEAT EXCHANGE APPARATUS HAVING MEANS FOR BACTERIAL REMOVAL

[75] Inventors: Gary D. Lang, Wooster, Ohio; David F. Giza, New Holland, Pa.

[73] Assignee: Liquid Carbonic Corporation, Chicago, Ill.

[21] Appl. No.: 705,119

[22] Filed: May 24, 1991

[51] Int. Cl.[5] ..... F24F 13/00

[52] U.S. Cl. ..... 62/305; 62/303

[58] Field of Search ..... 62/305, 303, 78; 165/95

[56] References Cited

U.S. PATENT DOCUMENTS

| | | | |
|---|---|---|---|
| 1,978,555 | 10/1934 | Snow | 257/1 |
| 2,097,851 | 11/1937 | Wenzl | 257/244 |
| 2,130,036 | 9/1938 | Shrader | 62/4 |
| 2,890,862 | 6/1959 | Heller | 165/95 |
| 3,320,964 | 5/1967 | Tripp | 62/303 |
| 3,528,259 | 9/1970 | Saal | 62/303 |
| 3,828,570 | 8/1974 | Stutz | 62/282 |
| 4,006,601 | 2/1977 | Ballarin et al. | 62/80 |
| 4,528,820 | 7/1985 | Jonasson | 62/80 |
| 4,570,447 | 2/1986 | Jonasson | 62/80 |
| 4,600,153 | 7/1986 | Stone | 62/303 X |

*Primary Examiner*—Albert J. Makay
*Assistant Examiner*—William C. Doerrler
*Attorney, Agent, or Firm*—Fitch, Even, Tabin & Flannery

[57] ABSTRACT

Heat exchange apparatus for food freezer refrigeration units including evaporator coils having liquid santizing spray apparatus mounted for reciprocatory movement across the upstream and downstream faces of the evaporator coils.

10 Claims, 2 Drawing Sheets

HEAT EXCHANGE APPARATUS HAVING MEANS FOR BACTERIAL REMOVAL

BACKGROUND OF THE INVENTION

This invention relates generally to heat exchange coils or evaporators and, more specifically, to heat exchange coils for use in connection with systems for cooling or freezing food products. Such heat exchange coils are a normal component of any mechanical refrigeration system in which a refrigerant is compressed and cooled in a condenser to liquify the refrigerant. The liquified and cooled refrigerant is then circulated through an expansion valve to an evaporator including the heat exchange coil where heat absorption by the refrigerant takes place. The refrigerant passes through the tubes or coils of the heat exchanger absorbing heat from air circulated between the tubes or coils.

Much of the apparatus used in connection with freezing various types of meat, chicken and fish, utilize mechanical refrigeration apparatus. Such refrigeration apparatus involves the cooling of air which is repeatedly recirculated through heat exchange coils. These coils typically include a large number of closely spaced sections of tubing through which a refrigerant is circulated. The air which is to freeze the food products is cooled by passing it into contact with exterior surfaces of the tubing and fins which are attached to the tubing to increase the effective heat transfer between the air and the refrigerant.

In connection with the preparation and freezing of such food products, it is extremely important that all possible steps be taken to maintain sanitary conditions within the food processing plant. There are many toxic types of bacteria which have been found to be present and thrive in such food processing plants. When problems develop with the output of such food processing plants being contaminated with such bacteria, it is often difficult to locate the source of such contamination. There are types of bacteria that may be transported in the circulating air and which may deposit and grow in various apparatus associated with the processing of such foods. In this connection it has been determined that in some instances bacteria have been deposited in the evaporator coils associated with the refrigeration apparatus for freezing such food products.

The risk of bacterial contamination in food freezing plants is particularly high in processing plants for freezing chickens. Such plants typically process a large volume of chickens which are slaughtered, dressed and frozen on a continuous processing line. The close proximity of the various steps in the processing and the difficulty in maintaining sanitary conditions during the very rapid processing of the chickens through these steps results in a high risk of such bacterial contamination of the product and the equipment used in the processing. As a consequence there is a need for food processing or food freezing equipment that is specifically designed to facilitate simple and effective cleaning to eliminate sources of bacterial food contamination.

In the conventional form of the evaporator or heat exchange coils used in refrigeration systems for freezing food products, there are many heat exchange tubes and interconnecting heat transfer fins and plates which are distributed throughout a fairly elongated passageway through which the air to be cooled passes. Because of the close proximity of the tubes and the heat transfer plates to each other, it is almost impossible to get sufficient access to the interior portions of the heat exchanger to enable one to clean and sanitize all of the areas through which the air to be cooled passes.

There are currently no evaporators on the market which include practical and effective means for cleaning and sanitizing the evaporator coils of equipment used in the fast freezing of food products such as chicken. There are patents relating to the removal of frost or ice from refrigeration heat exchange coils. U.S. Pat. Nos. 3,828,570 to Stutz teaches the spraying of an anti-freeze liquid onto the heat exchange tubes, to remove ice therefrom. The U.S. Pat. No. 2,097,851 to Wenzl discloses the use of a water spray to remove frost from heat exchange cooling coils. The use of heated air for defrosting heat exchange coils in an evaporator is shown in the U.S. patents to Shrader, U.S. Pat. No. 2,130,036 and to Ballarin et al. U.S. Pat. No. 4,006,601. U.S. Pat. Nos. 4,528,820 and 4,570,447 to Jonassen teach the use of compressed air to remove frost from heat exchange tubes. U.S. Pat. No. 1,978,555 to Snow which relates to a heat exchanger associated with a gas-fired heater, teaches the use of water spray means to clean soot off the heat exchange tubes therein.

SUMMARY OF THE INVENTION

The present invention includes the use of liquid spray mechanisms which are positioned on the upstream and downstream sides of heat exchange coils used in freezing food products. The heat exchange coils are dimensioned with the tubes of sufficient spacing both parallel to the direction of air flow, and transversely of the direction of air flow, so that the spray means on both sides of the heat exchange coils may deliver a sanitizing liquid directly against all of the tubes and fins in the heat exchange apparatus. In order to provide a heat exchanger of sufficiently limited length in the direction of air flow, so that the heat exchange tubes are accessible to the spray which is delivered from both sides, it may be necessary in some instances to divide the heat exchanger into two or more separated units, each having a support frame and being spaced apart sufficiently to permit the spray apparatus to be positioned on both sides of each of these separated heat exchange units.

Each spray mechanism includes a header supporting spaced nozzles to deliver liquid under pressure across the width of the heat exchanger. The header with its nozzles is supported on a carriage driven for reciprocating movement over the length of the heat exchanger to provide a spray which delivers liquid under pressure to all of the exposed surfaces of the heat exchange tubes and fins. Through the application of the liquid spray by means of the reciprocating mechanism on both sides of each set of heat exchange coils, it is possible to clean and sanitize the heat exchange coils in place in the refrigeration apparatus. The heat exchangers and the associated spray mechanisms may be used effectively in situations designed for horizontal or vertical air flow.

By providing the means for cleaning and sanitizing while the evaporator is in place and not disassembled from its associated processing equipment, there is less interruption to the freezing process. A drain and sump associated with the apparatus of the present invention allows the various solutions used in the spray means to be collected and disposed of simply and effectively.

Accordingly, it is an object of the present invention to provide an improved heat exchange apparatus for use in a food freezing application wherein liquid spray means are provided on the opposite sides of a heat exchange coil to clean and sanitize the coil.

It is another object of the present invention to provide an evaporator for use in a food freezer with liquid spray means mounted for reciprocation across the upstream and downstream ends of the evaporator to spray cleaning and sanitizing liquids against all of the exposed surfaces of the tubes and fins contained in the evaporator.

These and other objects of the invention should be apparent from the following detailed description for carrying out the invention when read in conjunction with the accompanying drawings.

DETAILED DESCRIPTION OF THE PREFERRED EMBODIMENT

Figure 1:
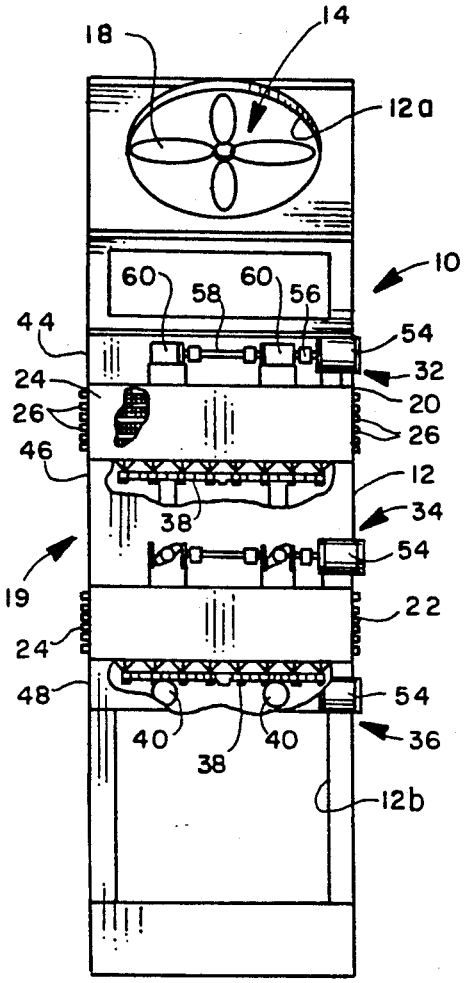
FIG. 1 is a front elevational view of a portion of a mechanical refrigeration unit including heat exchange apparatus embodying the invention, certain portions of the housing being cut away.
Figure 2:
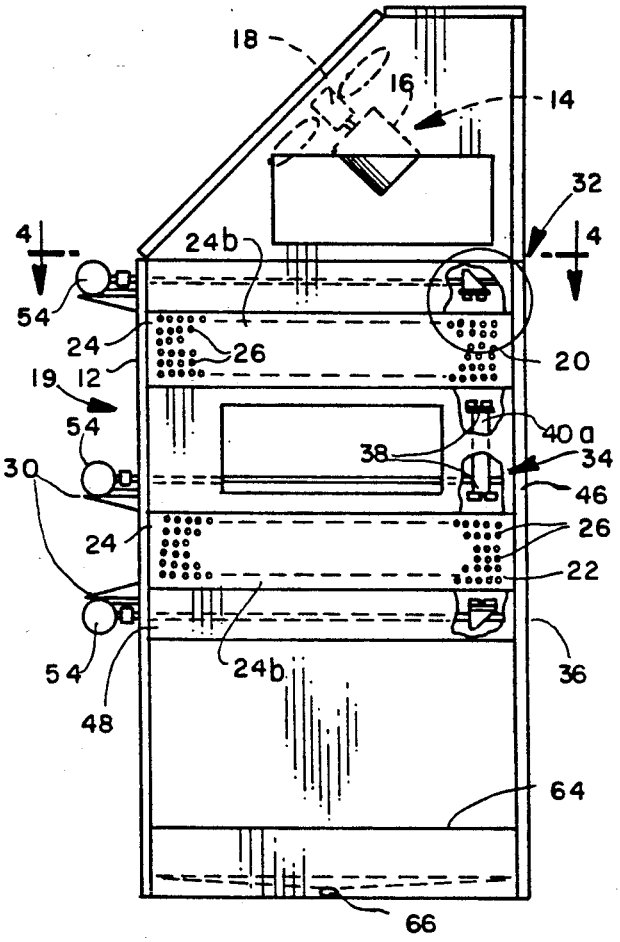
FIG. 2 is a side elevational view of the mechanical refrigeration unit of FIG. 1.

Referring to the drawings, there is shown in FIGS. 1 and 2 a mechanical refrigeration unit which is designated by the reference numeral 10. The mechanical refrigeration unit 10 is of the type usable in connection with freezing or cooling food products. The present invention involves only the heat exchange portion of the mechanical refrigeration unit 10. The refrigeration unit 10 includes a housing 12 within which there is mounted a motor-driven fan or blower 14 which includes a motor 16 and a air impeller 18. The housing 12 is formed with an air exit opening **12*a* through which air is discharged from the housing 12 by the blower 14. The lower portion of the housing 12 is provided with an air inlet opening 12*b* through which air to be cooled is drawn in by the blower 14**.

The central portion of the housing 12 is occupied by heat exchange apparatus 19 which is more commonly referred to as an evaporator. In the disclosed embodiment, the evaporator 19 is divided into two separate heat exchangers, an upper heat exchange unit 20 and a lower heat exchange unit 22. The heat exchange units 20 and 22 are essentially identical and are arranged in a superimposed relationship so that the air passing through the housing 12 encounters the lower heat exchange unit 22 and then passes through the upper heat exchange unit 20 before being discharged from the housing 12 through the opening **12*a***.

It should be understood that the mechanical refrigeration unit 10 would, in an operating situation include a compressor (not shown) which compresses a refrigerant gas and a condenser in which the heat is discharged to the atmosphere and the refrigerant liquifies. The refrigerant is then circulated through an expansion valve to an evaporator or heat exchange apparatus 19, at which time the refrigerant absorbs heat from the air passing through the heat exchange apparatus. Thereafter, the refrigerant in the gaseous state is recirculated back to the compressor and condenser where it is again compressed, liquified and cooled before being recirculated back to the evaporator. It should be understood that the conventional connections would be made between the heat exchange apparatus 19 and the portions of the mechanical refrigeration system which are not shown herein since they are entirely conventional.

Each of the heat exchange units 20 and 22 includes an open rectangular frame 24 having sidewalls **24*a* and 24*b*, and endwalls 24*c* and 24*d*. Extending transverse to the sidewalls 24*a* and 24*b* and supported therein are heat exchange tubes 26 which, as shown in FIG. 2, are disposed in six layers in each of the two heat exchange units 20 and 22. The tubes in each layer are equally spaced from each other, and the tubes in the six layers are all vertically aligned with each other so that the tubes 26** are aligned both horizontally and vertically. In the description of the arrangements of the tubes, they will be referred to as lying in parallel, horizontal and vertical planes. Recognizing the fact that the tubes have a finite diameter, it would be more accurate to state that their axes are disposed in these parallel horizontal and vertical planes. However, for simplicity in describing and claiming the disposition of the tubes, they will be described as lying in such planes.

In order to enhance the heat transfer between the air passing through the housing 12 and the refrigerant tubes 26, there are provided fins or plates 28 which are secured to the tubes 26 and extend parallel to the sidewalls **24*a* and 24*b*. The fins 28 are made of a heat conducting material in the conventional manner, and serve to increase the effective surface area across which heat transfer may take place between the heat exchange units 20 and 22 and the air passing therethrough. As best seen from the enlarged fragmentary showing of FIG. 3, the tubes 26** are spaced apart a distance substantially equal to the outside diameter of the tubes.

The heat exchange apparatus 19 is intended for use in the fast freezing of food. In such an application it is important to lower the temperature of the air passing through the heat exchanger to well below freezing, in order that the food may be frozen quickly with a minimum amount of deterioration of the food through loss of moisture. Accordingly, it is conventional in mechanical refrigeration units intended for this function to employ heat exchange units having substantial numbers of refrigerant tubes to increase the heat exchange between the air and the refrigerant which may be a fluorocarbon, ammonia or similar material. Since space is always at a premium in food processing plants, it has been the practice to arrange the refrigerant tubes in deep banks in relatively constricted air circulation passageways. As a consequence, the heat exchange units are typically several feet or more in depth, with perhaps 20 or 30 layers of heat exchange tubes through which the air is circulated. This extensive depth of tubes, along with the associated cooling fins, presents a structure which is efficient from a heat transfer standpoint but which is almost impossible to clean adequately, when that becomes necessary.

Recent studies have indicated that there are many sources of bacterial contamination possible in food processing plants. As a consequence, the industry has been very attentive to the design of all its processing equipment to minimize the possibility of any sort of bacterial contamination. In the freezing of foods it is conventional to recirculate the cooled air which is used to freeze the foods. The efficiency of the system is increased considerably if the chilled air is reused repeatedly. However, recirculating the air which is passed over such items as chicken carcasses raises the possibility that any bacteria on the food or the processing equipment may be airborne back into the air cooling equipment. Such bacteria that becomes deposited in the air cooling equipment may continue to grow and create a more serious source of contamination if not removed through periodic cleaning and sanitizing. Accordingly, it is important that the heat exchange portions of mechanical refrigeration units for freezing foods commercially be designed to permit such cleaning and sanitizing.

In order to accomplish the objective of providing a heat exchange apparatus which may be readily cleaned and sanitized, the heat exchange apparatus 19 is divided into the two separate heat exchange units 20 and 22, each of which is only six layers or tubes deep in the direction of air flow. It is within the purview of the present invention to increase this number of layers of tubes to a maximum of eight while still accomplishing the objectives of providing an evaporator unit which is readily cleaned and sanitized. It is also contemplated that the number of heat exchange units may be increased to three or even more in order to maintain the number of layers of tubes sufficiently low to facilitate the spray cleaning described herein.

To permit the periodic thorough sanitizing of the heat exchange units 20 and 22, there is provided a liquid spray apparatus 30 which includes an upper spray unit 32, an intermediate spray unit 34 and a lower spray unit 36. Each of the spray units includes a transverse header 38 which is supported by a pair of carriages 40. In order to translate the headers 38 laterally across the open frames 24 and their associated tubes 26, there are provided parallel worms or worm shafts 42 that extend lengthwise, parallel to the sidewalls **24*a* and 24*b* of the frame 24 and transversely with respect to the refrigerant tubes 26. The spray units 32, 34 and 36 include open rectangular frames 44, 46 and 48, respectively. The worms 42 are journalled in bearings 50 mounted in frames 44, 46 and 48, one of such bearings 50 being shown in the enlarged fragmentary view of FIG. 3**.

Lengthwise along the headers 38 there are mounted pairs of spray nozzles 52 which deliver overlapping conical sprays against the exposed exterior surfaces of the refrigerant tubes 26. As is shown in FIG. 1, there are eight pairs of spray nozzles 52 over the length of each header 38. The specific number and arrangement of the spray nozzles 52 may be modified or varied to meet the requirements of the respective heat exchanger, taking into account the nozzles and spray pressures available. Each of the carriages 40 is provided with an internally threaded passageway which engages one of the worms 42 to move the carriage and its respective header 38 axially along the worm 42. The worms 42 are driven by reversible motors 54 which are connected to the worms 42 through couplings 56, shafts 58 and gear boxes 60. In this way the motors 54 each rotate two of the worms 42 in synchronism, to drive the carriages 40 and headers 38 with their spray nozzles 52 across the open frames 24. Suitable controls are provided to automatically reverse the motors 54 when the carriages reach the limit of travel in either direction, so that a continuous spray across the entire extent of the evaporators 20 and 22 may be provided.

As may best be seen in FIG. 2, the uppermost spray unit 32 has its nozzles 52 directed downwardly into the refrigerant tubes 26 in the upper heat exchange unit 20. The lowermost spray unit 36 has its header 38 and spray nozzles 52 arranged to direct the liquid spray upwardly into the lower heat exchange unit 22. The middle spray unit 34 is different in that it employs vertically elongated carriages **40*a* which support headers 38 at the upper and lower ends as shown in FIG. 2. Accordingly, the headers on the carriages 40*a* have spray nozzles directed upwardly into the upper heat exchange unit 20 and downwardly into the lower heat exchange unit 22. Thus, only one motor 54 and set of worms 42 are required to reciprocate the spray nozzles for the lower portion of the upper heat exchanger 20 and the upper portion of the lower heat exchanger 22**.

During use of the spray apparatus 30, the mechanical refrigeration unit 10 is shut down periodically, at which time various types of liquids are automatically supplied through flexible delivery conduits or hoses 62 to the headers 38 and their respective spray nozzles 52. At the time the liquids are supplied through the flexible conduits 62, the motors 54 are actuated to reciprocate the upper, middle and lower spray units 32, 34 and 36 back and forth across the faces of heat exchange units 20 and 22. Depending on the nature of the contamination and the period of use, different types of liquids may be used. It is contemplated that detergent solutions, caustic solutions and bactericide solutions would be used, with a final water rinse to prepare the evaporators for use thereafter. In a vertical air flow situation as in the disclosed embodiment, the final rinse would be made only from above from the upper spray unit 32 to assure that any solid particles or debris would be carried downwardly to a sump 64 which has a drain opening 66.

Figure 5:
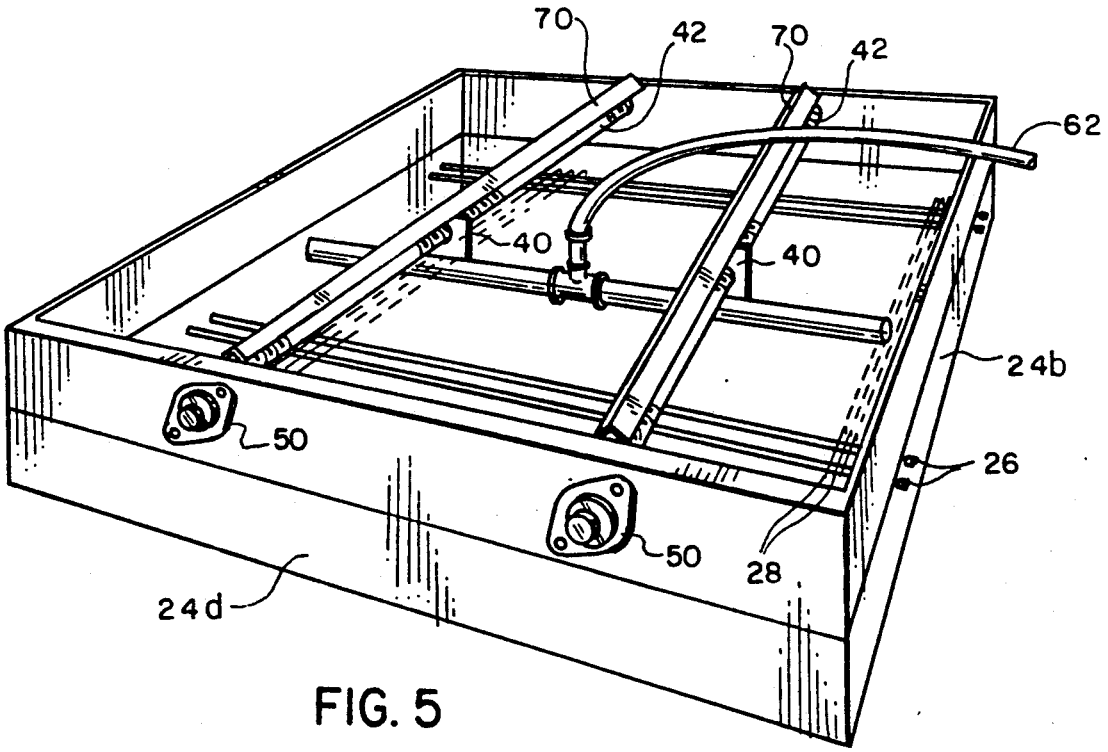
FIG. 5 is a fragmentary top perspective view of one of the heat exchange coils with one of its spray mechanisms.

The interior of the housing 12 defining the air passageway from the air inlet opening **12*b* through the heat exchange units 20 and 22 and to the exit opening 12*a* is formed of stainless steel, galvanized steel, or aluminum to resist corrosion. The air passageway is sealed so that liquids sprayed from the spray units 32, 34 and 36 will be contained within the housing 12 and will drain off downwardly into the sump 64. In order to protect the worms 42 from the possibly corrosive effects of the various cleaning and sanitizing solutions, protective shields 70 are mounted above the worms 42, as shown in FIG. 5. Shields 70 each have an inverted V-shaped cross section providing a shield to protect the worms 42 from spray and any liquids which might otherwise be directed onto the worms 42**.

Figure 3:
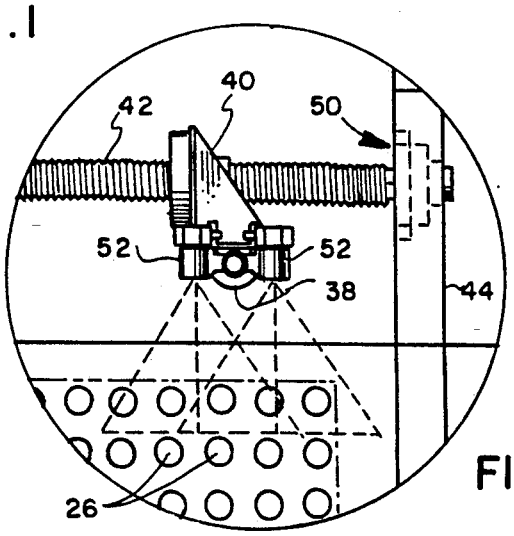
FIG. 3 is an enlarged fragmentary side elevational view of a portion of one of the spray mechanisms shown in FIGS. 1 and 2.
Figure 4:
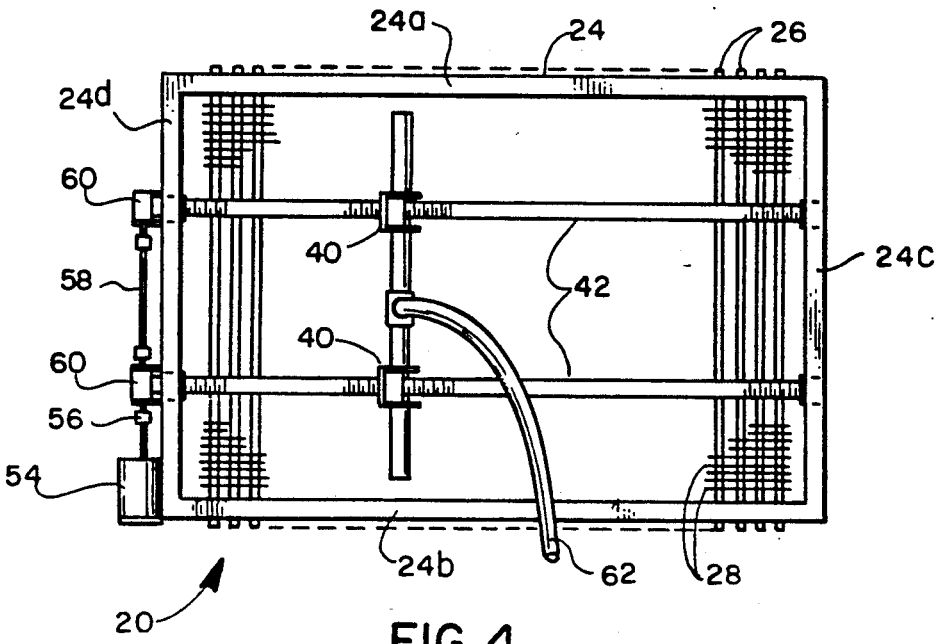
FIG. 4 is a sectional view taken on line 4—4 of FIG. 2.

The spray nozzles 52 provide fan-like or conical sprays, as shown in FIGS. 2 and 3, to deliver overlapping coverage throughout the entire area of the refrigerant tubes 26. The liquid from the nozzles 52 is directed in a divergent spray covering a wide area and then this spray pattern is moved transversely by the motor 54 and worms 42 to project liquid into direct engagement with most of the exterior surfaces of tubes 26 and, for the limited surface areas that are not directly engaged by the projected spray, the bounce or deflection of spray from other tubes 26 will still have sufficient velocity to assure adequate cleaning of all of the surface areas of the tubes 26 as well as the fins 28. It is contemplated that there could be additional banks of heat exchange tubes or additional heat exchange units equipped with their own liquid spray cleaning apparatus.

The heat exchange apparatus 19 with its associated spray apparatus 30 and housing 12 provide a combination that is particularly well suited to refrigeration applications involving any sort of contaminated air or cooling media that might result in undesirable deposits on the heat exchange tubes 26. The arrangement and disposition of the tubes 26 provide access for cleaning purposes and the spray apparatus 30 is constructed to present a minimum obstruction to air flow through the heat exchange apparatus 19, while functioning to completely spray clean and sanitize all of the exposed surfaces of the tubes 26. As indicated above, the heat exchange apparatus 19 and its associated spray apparatus may be arranged for any direction of air flow through the evaporators without lessening the effectiveness of the spray apparatus. The air flow through the evaporator units could be vertical or horizontal or at some acute angle therebetween. In such situations the spray mechanisms could spray at any desired angle to impact the refrigerant tubes in the same manner as described in connection with the disclosed embodiment.

Although the invention has been described in regard to a preferred embodiment, it should be understood that various changes and modifications as would be obvious to one having the ordinary skill in this art may be made without departing from the scope of the invention which is defined in the appended claims.

What is claimed is:

1. A mechanical refrigeration unit for use in cooling food products comprising:

a housing having an air inlet and an air outlet, a blower circulating air in through said air inlet, through said housing and discharging said air through said air outlet, a pair of separate evaporator sections mounted in said housing in alignment one with the other for cooling said air circulating successively through said evaporator sections, each evaporator including an open frame having sidewalls and endwalls and defining an air passageway through which said air circulates, refrigerant tubes mounted in said frame extending in parallel spaced relation between said sidewalls, liquid spray apparatus mounted for reciprocation at the upstream and downstream side of each of said evaporator sections, said liquid spray apparatus including elongated spray headers above and below each evaporator extending between said sidewalls parallel to said refrigerant tubes and reciprocation means for moving said headers back and forth between said endwalls, one of each of said pairs of headers being disposed to spray downwardly on each evaporator and one of each of said pairs of headers being disposed to spray unpwardly onto each evaporator, spray nozzles equally spaced along said headers and directed toward said evaporator sections to spray all of the surfaces of said refrigerant tubes exposed to air circulating through said housing, said reciprocation means including a plurality of pairs of elongated worms extended parallel to said sidewalls, a reversible motor drivingly coupled to each pair of adjacent worms, and a pair of carriages supporting each header at either end thereof, each carriage having a threaded portion engaging one of said worms for translating said header between said endwalls when said motor is energized to reciprocate said header, the liquid spray apparatus positioned between said evaporator sections includes a single pair of worms each one of which supports and reciprocates a dual carriage, said dual carriages support two parallel headers, one being positioned to spray into one of said evaporator sections and the other being positioned to spray into the other of said evaporator sections.

2. A mechanical refrigeration unit as set forth in claim 1 wherein said open frame is rectangular in shape having parallel opposed sidewalls and endwalls, said refrigerant tubes being mounted in said sidewalls extending perpendicular thereto, said refrigerant tubes being disposed in spaced parallel planes disposed perpendicular to the direction of air flow in said air passageway, the number of such planes and the spacing between such planes and such refrigerant tubes being such that said spray nozzles spray said liquid on all surfaces of said refrigerant tubes.

3. A mechanical refrigeration unit as set forth in claim 1 wherein each of said refrigerant tubes has an outer surface which is exposed to the air circulating through said passageway, said refrigerant tubes being disposed with respect to and spaced form each other such that the sprayed liquid from one or the other of said liquid spray apparatus impacts all of said outer surfaces of said refrigerant tubes.

4. A mechanical refrigeration unit as set forth in claim 1 wherein said refrigerant tubes are all equally spaced from adjacent tubes, and are disposed in first spaced parallel planes which are substantially perpendicular to the direction of air circulated through said passageway, said refrigerant tubes also being disposed in second spaced parallel planes perpendicular to said first parallel planes, each said refrigerant tube having an outer surface which is exposed to the air circulating through said passageway, said refrigerant tubes being spaced in said first and second planes a distance such that said liquid from one of said liquid spray header pairs impacts all outer surfaces of said refrigerant tubes.

5. A mechanical refrigeration unit as set forth in claim 1 wherein said evaporator sections are in vertical alignment and said housing is provided with a liquid sump which is coextensive with said evaporators and positioned beneath said evaporators to receive and collect the liquid sprayed from said liquid spray apparatus into said evaporators.

6. A method of maintaining sanitary conditions in the evaporator sections of a mechanical refrigeration system for cooling and freezing for products comprising the steps of:

dividing the heat exchange elements of said evaporator section to provide at least two spaced banks of refrigerant tubes, through which air to be cooled will be circulated successively through one and then the other, each of said banks having no more than eight layers of refrigerant tubes, positioning liquid spray means upstream and downstream of each of said banks of refrigerant tubes to direct sprays of sanitizing liquids against all of the exposed surfaces of said refrigerant tubes, supplying sanitizing liquids to said spray means to remove bacteria from all of the exposed surfaces of said refrigerant tubes.

7. A method of maintaining sanitary conditions in the evaporator section of a mechanical refrigeration system as set forth in claim 6 wherein said refrigerant tubes are equal in length and disposed in spaced parallel relationship, each said liquid spray means including a header having a plurality of spray nozzles spaced along the length of said header to produce a spray pattern that extends the length of a refrigerant tube, reciprocating each said header transversely of its length in a plane parallel to said refrigerant tubes to traverse said spray pattern across one of said banks of refrigerant tubes.

8. A method of maintaining sanitary conditions in the evaporator section of a mechanical refrigeration system as set forth in claim 6 wherein said banks of refrigerant tubes are vertically spaced one above the other, including the further step of rinsing said banks of refrigerant tubes by spraying water through said banked spray means after spraying said sanitizing liquids, and including final rinsing in which a water spray is supplied only from the uppermost of said spray means disposed above the upper one of said banks of refrigerant tubes to flush down any solids deposited in said banks of refrigerant tubes.

9. A method of maintaining sanitary conditions in the evaporator section of a mechanical refrigeration system as recited in claim 6 wherein said refrigerant tubes in each of said banks are disposed in spaced parallel planes which are perpendicular to the direction in which air flows through said evaporator section, said refrigerant tubes in each of said parallel planes being disposed in second spaced parallel planes which are aligned with said direction in which air flows.

10. A method of maintaining sanitary conditions in the evaporator section of a mechanical refrigeration system as recited in claim 17 wherein said parallel planes are sufficiently spaced apart that said liquid spray directed into said banks of refrigerant tubes impacts all of the exposed surface of said tubes.

* * * * *